United States Patent [19]

Shields et al.

[11] Patent Number: 4,725,106

[45] Date of Patent: Feb. 16, 1988

[54] RECONFIGURABLE WORK STATION FOR A VIDEO DISPLAY UNIT AND KEYBOARD

[75] Inventors: Nicholas L. Shields; Fred D. Roe, Jr.; Mary F. Fagg, all of Huntsville; David E. Henderson, Harvest, all of Ala.

[73] Assignee: The United States of America as represented by the Administrator of the National Aeronautics and Space Administration, Washington, D.C.

[21] Appl. No.: 805,011

[22] Filed: Dec. 5, 1985

[51] Int. Cl.[4] ..... A47B 21/00

[52] U.S. Cl. ..... 312/208; 108/3; 108/7; 312/7.2; 312/196; 312/300

[58] Field of Search ..... 312/208, 239, 196, 231, 312/324, 300, 7.2; 248/1 A, 1 B, 1 C, 1 E, 1 F, 1 H, 1 I, 1 J; 108/1, 3, 4, 6, 7, 8

[56] References Cited

U.S. PATENT DOCUMENTS

| | | | |
|---|---|---|---|
| 776,355 | 11/1904 | Selander | 312/239 |
| 2,230,444 | 2/1941 | Balster | 312/208 |
| 3,160,451 | 12/1964 | Lewis | 312/239 X |
| 3,847,461 | 11/1974 | Moeckl | 312/281 |
| 3,875,872 | 4/1975 | Kayner | 108/1 |
| 3,882,795 | 5/1975 | Korell | 108/1 |
| 4,047,774 | 9/1977 | Hanning | 312/196 X |
| 4,113,331 | 9/1978 | Derdzinski et al. | 312/231 X |
| 4,329,002 | 5/1982 | Cowen et al. | 312/196 |
| 4,365,561 | 12/1982 | Tellier et al. | 108/32 X |

*Primary Examiner*—Peter A. Aschenbrenner

*Assistant Examiner*—Thomas A. Rendos

*Attorney, Agent, or Firm*—William J. Sheehan; John R. Manning; Leon D. Wofford, Jr.

[57] ABSTRACT

A reconfigurable workstation (10) is illustrated having video, keyboard, and hand operated motion controller capabilities. The workstation includes main side panels (12, 14) between which a primary work panel (A) is pivotally carried in a manner in which primary work panel (A) may be adjusted and set in a negatively declined or positively inclined position for proper forearm support while operating hand controllers (34, 36). A keyboard table (B) supports a keyboard (32) in such a manner that the keyboard (32) is set in a positively inclined position with respect to the negatively declined work panel (A). Declined forearm support surfaces (26, 28) are provided on either side of an alcove (24) accommodating a seated operator with forearms of the operator supported in a declined position for proper support and operation of the hand controllers (34, 36). A visual display unit (C) is inclined with respect to primary work panel (A) so that the operator seated at alcove (24) is properly positioned. With the proper declination of work panel (A) and inclination of keyboard (32) and a visual display unit (64), keys (33) of keyboard (32) and the screen of visual display units (62, 64) are well within the focal cone (106) of operator (96). Various adjustable devices (70, 90, 98, and 102) are provided for adjusting the relative declinations and inclinations of the work panels, tables, and visual display panels.

19 Claims, 4 Drawing Figures

Fig. 1.
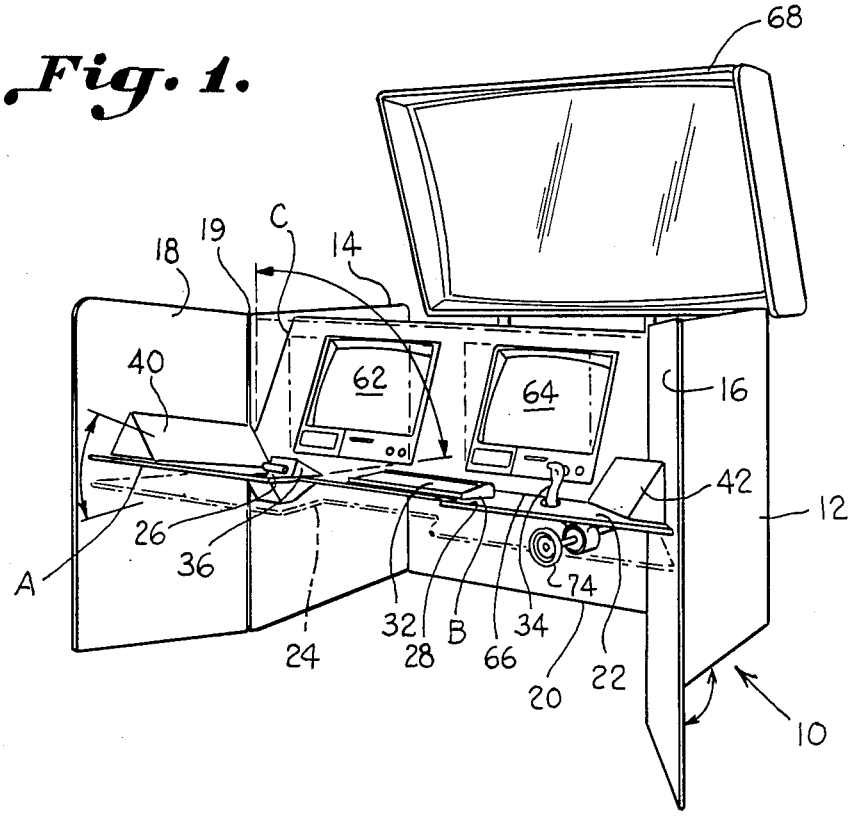
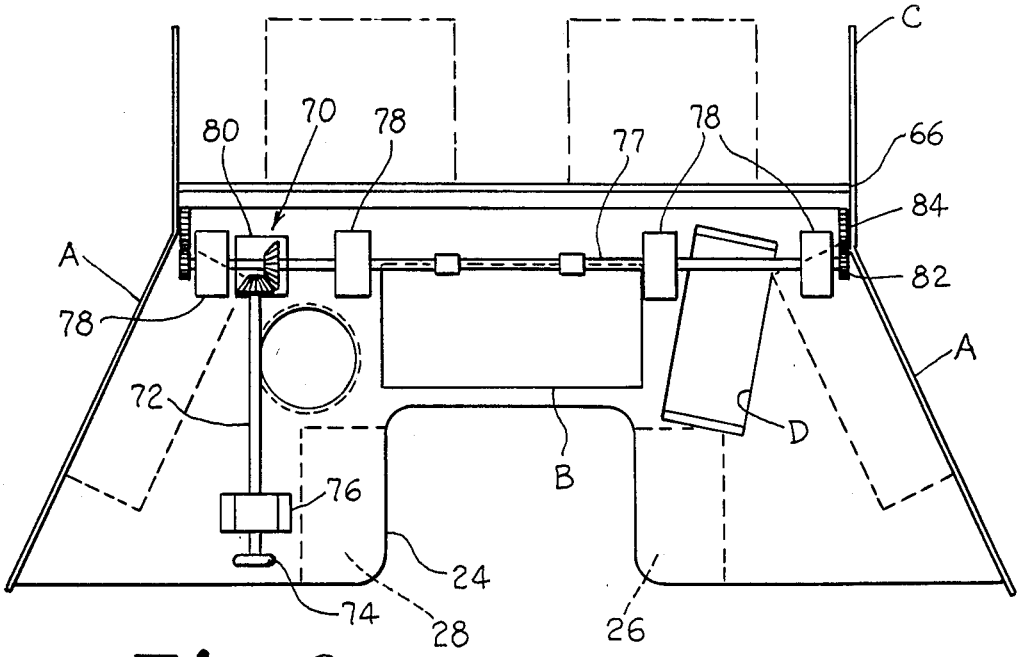
Fig. 2.

Fig. 3.
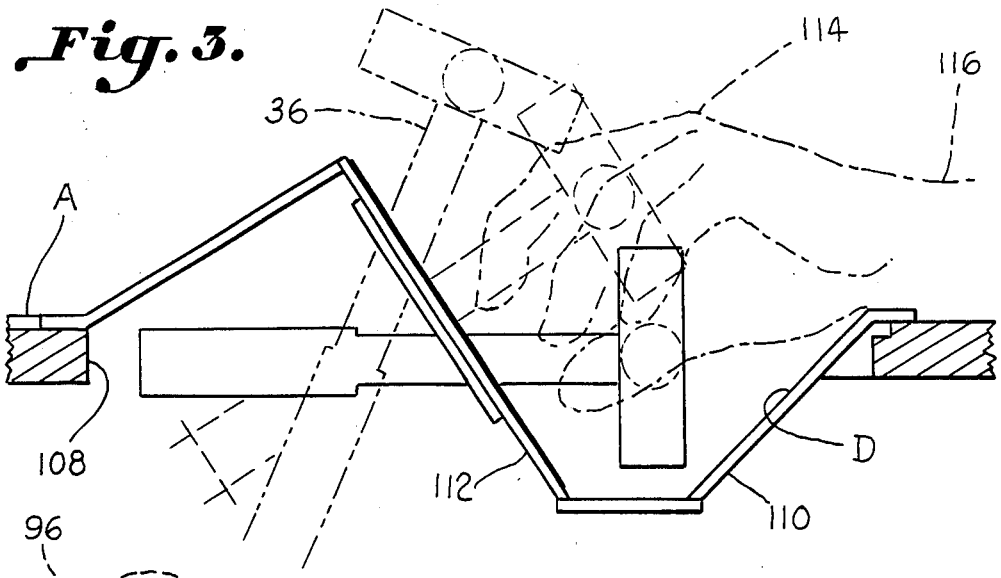
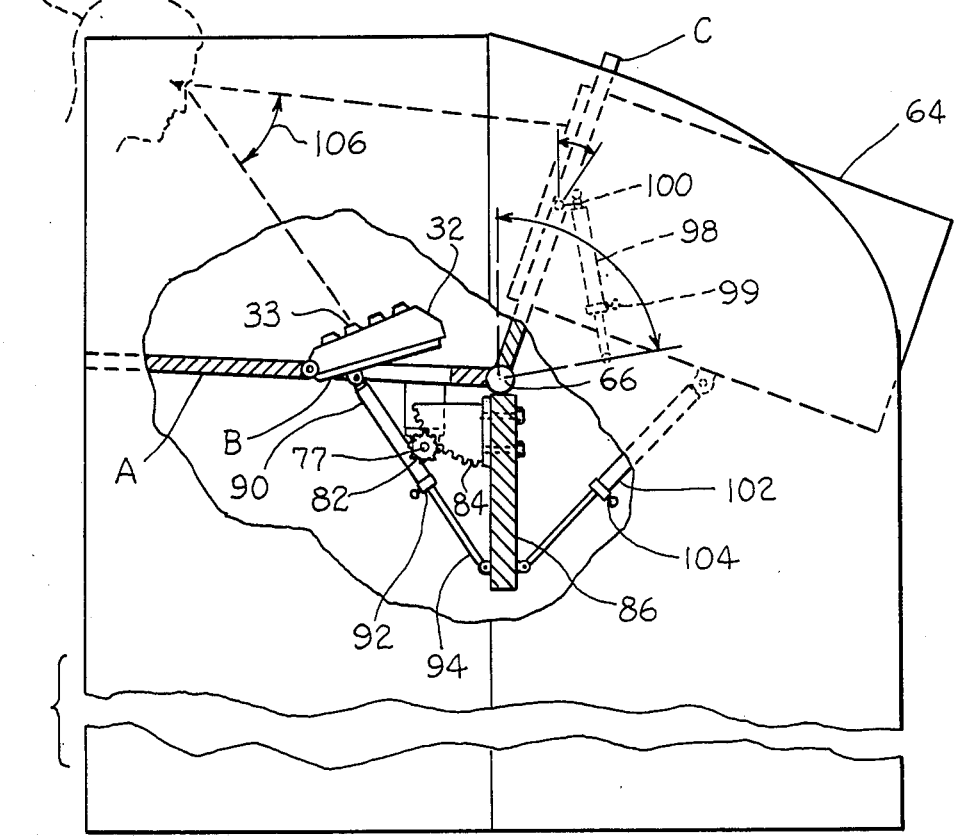
Fig. 4.

RECONFIGURABLE WORK STATION FOR A VIDEO DISPLAY UNIT AND KEYBOARD

ORIGIN OF THE INVENTION

The invention described herein was made by an employee of the U.S. Government and by employees of a contractor in performance of work under a NASA contract, and it is subject to the provisions of Public Law 96-517 (35 U.S.C. 202), under which provisions the contractor has elected not to retain title.

BACKGROUND OF THE INVENTION

This invention relates to the provision of a workstation incorporating the operational and anthropomorphic requirements of the human operators performing viewing and keying activities at the workstation. The work station is designed to accommodate visual display and feedback, and controller operations and keyboard tasks as an integrated set of operations for the 5th to the 95th percentile of the operator population.

The reconfigurable workstation is particularly advantageous for use in the space program for simulating and controlling maneuvers in space of remote manipulators, vehicles, etc.

Prior designs have been proposed for workstations including keyboards, and controllers and visual display units. These prior designs treat each component's operation as separate from any of the others and result in design incompatibilities when the overall system operations are evaluated. Typing keyboards are to be sloped approximately 15 degrees toward the operator and provide palm support. Hand controllers are to provide full arm support; and video display units (VDU) should be tilted 15 to 25 degrees upwards toward the operator.

The conventional workstation configurations result in a VDU which is located too high with respect to the operator's keyboard and a comfortable keyboard. The keyboard is typically tilted too much toward the operator with regard to hand controller or joystick operations. A support surface for joystick operations is provided in the conventional designs which does not adequately support the operator's arms.

U.S. Pat. No. 3,847,461 discloses a data processor workstation having a keyboard which is horizontal and sloped toward the operator. The VDU is generally horizontal or at a slight angle. U.S. Pat. No. 4,365,561 discloses a workstation for a computer terminal wherein the keyboard is sloped downwardly and based on a horizontal surface. The video display unit is dropped downwardly so that the line of sight is sloped upwardly toward the operator. No provision is made in either of the above such as joystick, trackballs, or other control switches which may be utilized, for example at a CAD station.

The primary disadvantages of the prior art, which consists of simply stacking VDU's, keyboards, or hand controllers on a conventional workplace, are human operator fatigue, incompatible eye/hand feedback, and excessive head and hand movements. All the above result in decreased productivity by increasing operations time and error rates.

Accordingly, an object of the present invention is to provide a reconfigurable workstation in a systematic framework wherein the visual, manipulative, and spatial requirements are taken as an interactive proposition rather than individually.

Another object of the invention is to provide a reconfigurable workstation which provides for the correct performance of tasks involving hand controllers wherein the forearms are positioned in a slightly declined manner from the elbow.

Still another object of the invention is to provide a reconfigurable workstation wherein arm supports are provided for the correct sustained performance of tasks involving hand controllers when the forearms are supported in a negatively declined position and the keyboard in a positively inclined position such that the successive rows of keys face upwards toward the operator.

Still another object of the invention is to provide a reconfigurable workstation which may be adjusted and reconfigured for the operator to provide for sustained support during long simulations of space flight or other long durational tasks such as word processing or computerized design without fatigue.

Another object of the invention is to provide a reconfigurable workstation wherein the visual display units are reconfigurable to reduce tedious and numerous head movements.

SUMMARY OF THE INVENTION

The above objectives are accomplished according to the present invention by providing a reconfigurable workstation which includes a primary work surface which may be tilted from a horizontal position upwards to a declined position. This support surface supports the forearms below the elbow. The keyboard unit is built into the primary support surface, and may be adjusted relative to the primary support surface to present the keyboard in an alterable position for operation. A visual display unit is also reconfigurable and supported in a primary visual panel which can be tilted from zero to 90 degrees. Alternately, a large screen display may be provided and mounted in front of the workstation itself. A view of either of the two primary visual monitors or a third independent display may be provided on the large screen display. The workstation operator can easily see over the primary display panel and view the large screen display together with other mission personnel without interference.

The overall workstation physically and perceptibly focuses the operator's attention, eyes, and hands into the three primary control and display areas. This reduces the operating response time and decreases the probability of error since the input devices and operator feedback are co-located. Operator fatigue will be reduced as a function of the arm, wrist, and hand support offered in the functional grouping in the primary work areas. Other significant advantages of the reconfigurable workstation include the relative attitudes of the manual and visual work panels being adjustable to accommodate a wide range of potential user population.

A unique characteristic of the workstation is that the primary work surface slopes away from the operator and that this slope is adjustable to suit the individual requirements of the operator and the task. This is a radical departure of the conventional designs of operator panels which usually slope toward the operator, forcing the operator to bend his or her wrists up, constraining the position of the VDU to be above a convenient and comfortable line of sight. The reconfigurable workstation incorporates the human factor requirements into the engineering design rather than ignoring them or imposing them after the fact.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1 is a perspective view illustrating a reconfigurable workstation constructed in accordance with the present invention.

FIG. 2 is a bottom plan view of the primary work panel of FIG. 1 illustrating the arrangement for adjusting the declination of the work panel;

FIG. 3 is a sectional view illustrating a hand-controller recess for reducing wrist fatigue constructed in accordance with the present invention; and FIG. 4 is a side elevation with parts cut away and taken in section illustrating the adjustable features of a reconfigurable workstation constructed in accordance with the present invention.

DESCRIPTION OF A PREFERRED EMBODIMENT

Referring now in more detail to FIG. 1, a reconfigurable workstation is designated generally at 10 which includes a pair of main side panels 12 and 14. There are a pair of side secondary display panels 16 and 18 which are hinged at 19 to side panels 12 and 14 of the workstation.

A primary work panel A is provided which may be adjusted in its position from a horizontal position to a negatively declined or positively inclined position of approximately 20 degrees, or any increments therebetween. Primary work panel A provides a desk top and includes an alcove 24 in front of the desk at a side where an operator may be seated.

The alcove permits the operator to be correctly positioned for keyboard and visual display functions, but is designed principally to support the operator's forearms and wrists during joystick or hand controller operations on either side thereof. There is a declined forearm support at 26 on one side of alcove 24 and a declined forearm support 28 on the opposing side of the alcove. The primary work panel can be outfitted with one or two hand controllers on either side of the keyboard panel. The primary work panel permits the operator to adjust the attitude of the work surface of the panel in a negative or positive attitude with respect to the operator. Unlike flat tables or inclined or sloped panels found on conventional desks, the reconfigurable workstation may be declined away from the operator permitting full support of the operator's arms during hand movements. This declination has the effect of physically focusing the operator's attention and movements into the primary work area defined by work panel A, a keyboard table B, and a visual display panel C.

Keyboard table B is carried by primary work panel A designed to accommodate a wide range of keyboard configurations. A keyboard 32 is carried on the table equipped with standard alphanumeric keys 33 (FIG. 4), as well as special function keypads. The keyboard table may move through an arc of 30 degrees, below and above horizontal, allowing the operator to adjust the keyboard to his or her own comfort and task system requirement. The alcove 24 permits the operator to be correctly positioned for keyboard use; however, the alcove is designed primarily as an inwardly cut recess in work panel A to facilitate declining support of the operator's forearms and wrists to operate the joystick or hand controller operations.

A first hand controller includes a joystick illustrated at 34 for controlling rotational motions (pitch, yaw, roll). A second hand controller includes a translation motion controller illustrated at 36. Hand controller 36 controls translational motion in three degrees of freedom (x, y, z). It can be seen that these devices can be operated very comfortably with the forearms supported in a declined position for optimal support. The primary support panel can be outfitted with the hand controllers on either side of the keyboard table B. The adjustable or reconfigurable primary support panel permits the operator to adjust the attitude of the work surface in a negative or positive attitude with respect to the operator.

There are secondary control panels 40 and 42 located to the left and right side of the operator alcove within the reach envelope of male and female operators for the 5th to 95th percentile of the human operator. Panels 40 and 42 may house secondary controls as the mission task may require. The secondary control panels are independently slanted surfaces attached to primary support surface 22 of work panel A. They are designed to be removable to permit reconfiguration of the workstation as a function of the mission requirement. The secondary control panel design continues to emphasize the focusing of the operator's attention to the primary work envelope.

Pivotal secondary display panels 16 and 18 are hinged on the two main vertical sides 12 and 14, respectively (FIGS. 1 and 4). Secondary display panels 16 and 18 provide an environmental enclosure as well as providing for mounting of infrequently used displays. While controls can also be mounted on these panels, they will be outside of the nominal reach envelope for some operators. For this reason, only appropriately formatted displays may be considered for the secondary display panel.

Primary visual panel C includes two visual display units (VDU) 62 and 64 of up to 19 inches diagonal and their associated controls for brightness, contrast and focus (FIGS. 1 and 4). Primary visual display panel C is adjustable in pitch, angle, or inclination to accommodate variability in the operator population, as well as individual operator viewing preference for viewing angle.

Primary visual display panel C is pivoted in common with primary work panel A about pivot 66. The primary visual panel includes the two individual display units 62 and 64 which may be individually tilted-in towards the operator's focal point, thereby reducing eye-scanning requirements.

A large overhead display screen 68 is the third of the secondary components (FIG. 1). The three-by-four-foot television projection display is mounted in front of the workstation itself, and provides a view of either of the two primary visual monitors or a third independent display. The workstation operator can easily see over primary display panel C because of its design, and other mission personnel can view large screen display 68 from a distance and not interfere with the activities and responsibilities of the system operator.

Referring now to FIG. 2, a first adjustment means, designated generally as 70, is illustrated for adjusting the inclination or negative declination of primary work panel A, and includes means for positively and incrementally controlling the declination of the panel. As can best be seen in FIG. 2, the positive incremental declination control means 70 is carried underneath work panel A. Positive incremental declination control means 70 includes an operator shaft 72 having a manually operated hand wheel 74. There is a gear box 76 affixed to the underneath side of panel A which interconnects the hand wheel 74 and operator shaft 72 by suitable gear ratio drive. There is a drive shaft 77 carried transverse to operator shaft 72 which rotates in pillow blocks 78 affixed to the underneath side of panel A. There is a speed reducing gear box 80 which interconnects the operator shaft 72 and drive shaft 77.

Referring to FIG. 4, it can be seen that drive shaft 77 includes a spur gear 82 carried on one end which meshes with a rack gear 84 which is illustrated in the form of a gear section attached to a beam 86 which spans between vertical sides 12 and 14 of the workstation. As hand wheel 74 is turned, spur gear 82 is turned causing the teeth to travel up and down gear section 84. This causes primary work panel A to pivot upwardly altering the negative declination of the work panel with respect to the horizontal.

Second adjustment means for adjusting the positive inclination of keyboard table B is illustrated in the form of an air spring 90 which includes a slideable abutment 92 that may be adjusted along a rod 94 of air spring 90 to set the air spring in a desired position, and hence table B in a desired positive inclination. In FIG. 4 it can be seen that primary work panel A is in a negatively declined attitude, while keyboard table B is in a positively inclined attitude, so that the successive rows of keys 33 of keyboard 32 are inclined toward an operator 96 seated at alcove 24.

Third adjustment means for adjusting the inclination of visual display panel C is provided by an air spring 98 having an adjustable abutment ring 99 which may be set by a set screw to set the position of the air spring, and hence the inclination of visual display panel C. One end of air spring 98 may be connected to visual panel C as can best be seen in FIG. 4. The opposing end of air spring 98 may be fixed the work station. The visual display units 62 and 64 may be individually tilted about a pivot 100 in a window of the visual display panel C, and held in the desired tilted position by yet another air spring 102 and adjustable abutment ring 104. The air springs are conventional and, of course, other suitable means for adjusting or setting the position of the keyboard table, visual display panel, and VDU's may also be utilized.

As can best be seen in FIG. 4, by properly positioning work panel A, keyboard table B, visual display panel C, and visual display units 62 and 64, keys 33 of keyboard 32 and the visual display screen of visual display unit 64 are well within the focal cone 106 of the operator 96. In this position, the operator may view the keys and the display screen without unnecessary head movement.

Referring now to FIG. 3, it can be seen that the translational controller 36 is carried within a recessed well D which is formed in an opening 108 in work panel A. A first wall 110 slopes downwardly below work panel A, and a second wall 112 is inclined both to the first wall 110 and work panel A. The second wall 112 projects above and below work panel A, and slideable and rotatably receives hand controller 36. Hand controller 36 may be moved left or right, up or down, and in and out with respect to wall 112 to provide control of translational motion and three degrees of freedom (x, y, z). In this position, the hand 114 of the operator may grip the T-handle of the hand controller 36 with the wrist in a slightly dropped position relative to the forearm 116 to reduce wrist fatigue while operating the hand controller 36. This type of fatigue is particularly common with the operation of translational motion controllers.

The workstation may be utilized for controlling any number of operations in which control of rotational and translational motions is needed. For example, the workstation may be utilized to control the movements of manipulator arms in space, or remotely from other locations. In space vehicle applications, the workstation may be utilized to control thruster movements and downrange, crossrange, and elevation vehicle positions. For example, the translation controller 36 may be utilized to control the arm movements of a remotely controlled manipulator arm. The rotational controller 34 may be utilized to control the pitch, yaw, and roll movements of the wrist portion of the manipulator arm.

Thus it can be seen that a highly advantageous construction can be had for a reconfigurable workstation which considers the workstation requirements in a systematic framework. The visual, manipulative and spatial requirements are taken as an interactive proposition rather than one at a time. Arm support, for instance, is crucial to the correct sustained performance of tasks involving hand controllers. The most comfortable support position for the forearms is slightly declined from the elbow. Keyboard operations, on the other hand, are most effectively accomplished with the successive rows of keys inclined slightly toward the operator. The reconfigurable workstation achieves both of these operational advantages by positively inclining the keyboard with respect to the negative decline of the work panel.

The reconfigurable workstation provides optimal positioning of the position and orientation of the visual display with respect to the keyboard. Conventional systems place the display behind and up from the keyboard such that the operator must nod his or her head up and down while going from the keyboard to the visual display. The reconfigurable workstation places the visual displays beyond the keyboard and in the line of sight with the inclination of the keyboard, which minimizes operator head movement.

While a preferred embodiment of the invention has been described using specific terms, such description is for illustrative purposes only, and it is to be understood that changes and variations may be made without departing from the spirit or scope of the following claims.

What is claimed is:

1. A reconfigurable workstation for manual keyboard and hand controller operation and for video display comprising:

a pair of vertical main side panels;

means spacing said side panels apart;

a primary work panel pivotally carried between said side panels in a manner that said primary work panel may be tilted downwardly away from an operator in a negative declination or positively inclined upwardly from said operator seated at said work panel;

a keyboard table pivotally carried by said primary work panel which may be positioned at a positive inclination relative and opposite in direction to the negative declination of said work panel for supporting a keyboard for operation by said operator;

first adjustment means connected to said work panel for adjusting the negative declination of said primary work panel;

second adjustment means connected to said keyboard table for adjusting the positive inclination of said keyboard table with respect to said work panel;

said first and second adjustment means adjusting said work panel and keyboard table so that said primary work panel may be declined downwardly, and said keyboard may be oppositely inclined upwardly, whereby the successive rows of keys of the keyboard are inclined toward the operator while the arms of the operator are positioned in a negatively declined position for the comfort of the operator and to meet the system task requirements;

an operator alcove in which said operator sits at said primary work panel defined by an inwardly cut recess formed in said work panel inwardly of a front edge of said work panel in the direction of the declination of said work panel;

a hand controller carried by said primary work panel adjacent said keyboard table, and a declined forearm support formed on opposing sides of said alcove for supporting the forearms of said operator while seated at said panel and operating said hand controllers;

said forearm support terminating at a wrist support including a recessed well formed in said work panel extending below the level of said primary work panel; said hand controller being carried in said recessed well in a manner that the wrist of said attendant is bent downwardly from said forearm during operation of said hand controller; and said hand controller carried in said recessed well including a translational motion controller having a hand operated member which moves in three degrees of rectilinear motion to produce control signals representing movements of three degrees of freedom.

2. The workstation of claim 1 wherein said primary work panel includes a back edge; a pair of parallel sides extending from said back edge terminating in a pair of diverging sides which diverge from said parallel sides outwardly toward said front edge of said work panel; said back edge of said work panel being pivotally attached to said workstation between said side panels.

3. The workstation of claim 2 including a pair of diverging secondary side panels hinged to said main side panels which diverge outwardly and follow the contour of said diverging sides of said work panel providing an environmental enclosure facilitating focusing of the operator's attention to within a primary work envelope between said side panels.

4. The workstation of claim 3 including secondary control panels carried by said primary work panel abutting said diverging secondary side panels having a slanted display surface which extends from said work panel to said secondary side panels at an angle thereto focusing the operator's attention to a primary work envelope between said side panels.

5. A reconfigurable workstation for keyboard and hand controller operation by an operator and for video display comprising:

a pair of vertical main side panels;

means spacing said side panels apart;

a primary work panel included in said workstation pivotally carried between said side panels in a manner that said primary work panel may be tilted downwardly in a negative declination away from an operator seated at said work panel;

a keyboard table pivotally carried by said primary work panel in a manner that said keyboard may be set in a positive inclination with respect to said declined work panel for supporting a keyboard for operation by said operator;

a visual display panel included in said workstation pivotally carried between said side panels at an inclination having at least one visual display window formed by a cutout in said visual display panel for receiving a visual display unit;

a visual display unit pivotally carried within said visual display window in a manner that the inclination of said visual display panel may be adjusted relative to said primary work panel and the inclination of said visual display unit may be individually adjusted within said visual display window so that the visual display unit may be tilted in toward a focal cone of said operator seated at said workstation to thereby reduce eye-scanning requirements;

means connected to said visual display unit for adjusting said visual display unit within said visual display window;

a primary work area defined by the primary visual display panel, work panel, and keyboard tables;

first adjustment means connected to said primary work table for adjusting and setting the negative declination of said primary work panel which focuses the operator's attention and movements into the primary work area of the three panels;

second adjustment means connected to said keyboard table for adjusting and setting the inclination of said keyboard table in a manner that said primary work panel may tilt downwardly and said keyboard may tilt upwardly so that successive rows of keys are inclined toward the operator to the comfort of the operator and to meet the system task requirements; and third adjustment means connected to said visual display panel for adjusting and setting the inclination of said visual display panel in said workstation.

6. The workstation of claim 5 including an alcove in which said operator sits at said primary work panel defined by a recess cut in said work panel inwardly of the front edge of said work panel in the direction of the declination of said work panel and terminating adjacent said keyboard table.

7. The workstation of claim 6 wherein said first adjustment means includes an operator shaft having a hand wheel within reach of said operator seated at said alcove, a drive shaft carried by said work panel at 90 degrees to said operator shaft, and a speed reduction gear mechanism connected between said operator and drive shafts, said shafts and gear means carried by said drive shaft for raising and lowering said work panel in response to hand operation of said hand wheel.

8. The workstation of claim 6 including a manual hand controller carried by said primary work display panel on opposing sides of said keyboard table; and a pair of declined arm support surfaces formed on opposing sides of said alcove for supporting the forearms of the operator while seated at said primary work panel in a manner that the forearms are negatively declined while operating said hand controller.

9. The workstation of claim 8 wherein said manual controllers include a first hand controller for controlling translational motion, and a second hand controller for controlling rotational motion; a recessed well formed in said work panel for receiving said operator's wrists while operating said first hand controller, permitting said wrist to be bent downward from said forearm for reducing wrist fatigue.

10. The workstation of claim 9 wherein said recessed hand-controller well includes a first wall sloping downwardly from said work panel, a second wall inclined to said work panel and said first wall projecting above and below said work panel, and said translational hand controller being carried by said second wall.

11. The workstation of claim 5 including a second display window formed in said visual display panel, and a second visual display unit carried in said second display window, in a manner that the inclination of said visual display unit may be adjusted relative to said visual panel and primary work panel.

12. The workstation of claim 5 including a large overhead screen display carried above said visual display panel providing a display which can easily be seen over the primary display panel, and whereby other mission personnel can view the screen display in the distance and not interfere with the responsibilities of the workstation operator.

13. The workstation of claim 5 wherein said primary work panel includes opposing side edges which taper inwardly in the direction of the declination of said work panel within said workstation further focusing the operator's attention within the primary work area.

14. The workstation of claim 5 wherein said second and third adjustment means include air springs with adjustable abutment means which fix the position of said air springs in a desired position corresponding to the desired inclination of said keyboard table and visual display panel, respectively.

15. The workstation of claim 5 wherein said primary work panel includes tapering sides which taper inwardly toward said visual display panel, and including a pair of diverging secondary side panels hinged to said main side panels of said workstation and diverging outwardly along the lines of said tapering sides of said work panel.

16. A reconfigurable workstation for keyboard and hand controller operation and for video display comprising:

a pair of vertical side panels;

means spacing said side panels apart;

a primary work panel included in said workstation pivotally carried between said side panels in a manner that said primary work panel may be tilted downwardly in a negative declination away from an operator seated at said work panel;

a keyboard table pivotally carried by said primary work panel in a manner that said keyboard table may be adjusted in a positive inclination with respect to said work panel tilted in said negative declination for properly supporting a keyboard for operation by said operator;

a visual display panel included within said workstation pivotally carried about a common pivot with said primary work panel in such a manner that said visual display panel is negatively declined;

first adjustment means connected to said primary work panel for adjusting the declination of said primary work panel;

second adjustment means connected to said keyboard table for adjusting the inclination of said keyboard table;

third adjustment means connected to said visual display panel for adjusting the inclination of said visual display panel;

a hand controller carried by said primary work panel on one side of said keyboard table;

an alcove in which said operator sits at said primary work panel defined by an inwardly cut recess formed in said work panel inwardly of a front edge of said work panel in the direction of the declination of said work panel;

a declined forearm support surface formed on the side of said alcove for supporting the forearm of said operator while seated at said panel and operating said hand controller; and positive incremental declination control means included in said first adjustment means for adjusting the declination of said primary work panel in well defined increments in a manner that the work panel may be incrementally varied from a horizontal position to a number of negatively declined positions relative to the operator seated at said workstation facilitating adjustment in the declination of said declined forearm support.

17. The workstation of claim 16 wherein said positive incremental declination control means includes a manually operable gear drive arrangement carried by said workstation underneath said primary work panel which may be manually operated by said operator seated at said alcove.

18. The workstation of claim 16 wherein said positive incremental declination control includes:

an operator shaft carried by said primary work panel having a manually operated hand wheel within reach of said operator;

a rotary drive shaft carried transverse to said operator shaft;

a speed reducing gear box interconnecting said operator and drive shafts;

gear means carried on the ends of said drive shaft; and rack gear means affixed to said work station in engagement with said gear means.

19. The workstation of claim 18 including a visual display unit carried by said visual display panel for displaying an object being controlled by said workstation; and said visual display panel and said visual display unit being pivotally carried at said workstation in a manner that the inclination of each may be individually adjusted with respect to said primary work panel.

* * * * *